United States Patent [19]

Lariosa

[11] 4,133,125

[45] Jan. 9, 1979

[54] SELF-ERECTING SIGN POST

[76] Inventor: Oscar A. Lariosa, 6734 NW. 5th Ave., Miami, Fla. 33150

[21] Appl. No.: 780,814

[22] Filed: Mar. 24, 1977

[51] Int. Cl.[2] ..... G09F 15/00

[52] U.S. Cl. ..... 40/608; 403/229

[58] Field of Search ..... 403/2, 286, 229; 40/145 R, 145 A, 145, 125 H, 608; 52/95

[56] References Cited

U.S. PATENT DOCUMENTS

| | | | |
|---|---|---|---|
| 1,828,892 | 10/1931 | Felton | 40/145 A X |
| 3,355,998 | 12/1967 | Roemisch | 403/2 |
| 3,861,814 | 1/1975 | Fisher | 403/229 |
| 3,912,404 | 10/1975 | Katt | 403/2 |

FOREIGN PATENT DOCUMENTS

| | | | |
|---|---|---|---|
| 19486 of | 1909 | United Kingdom | 40/145 A |
| 19390 of | 1912 | United Kingdom | 40/145 A |

*Primary Examiner*—Russell R. Kinsey
*Assistant Examiner*—Wenceslao J. Contreras
*Attorney, Agent, or Firm*—Ernest H. Schmidt

[57] ABSTRACT

A self-erecting sign post has a rigid but frangible section along its length at its lower end and a coextensive helical spring circumjacent the rigid section and interconnecting the separated post portions, the assembly being such that the frangible section constitutes a zone of weakness which will break before the remainder of the sign post bends upon impact, the spring being operative to restore the sign post to its erect position until the frangible section can be replaced.

4 Claims, 3 Drawing Figures

SELF-ERECTING SIGN POST

This invention relates to sign posts and is directed particularly to a novel and improved post support and spring mechanism for automatically returning traffic sign posts and the like to erect position after being accidentally bent or downed upon being struck by an automotive vehicle.

Metal sign posts carrying stop signs, street signs and the like, because of their proximity to the vehicular roadway, are not infrequently damaged by improperly driven vehicles, usually during backing or turning around, or as a secondary result of collision of two or more vehicles at the site. Such sign damage, particularly if the damaged sign post carries a traffic warning sign such as a stop sign, presents a very serious driving hazard. For example, if a bent stop sign is displaced by any substantial amount it may not be observed by an otherwise alert driver, as a result of which he might assume he has the right-of-way in passing through a dangerous intersection whereas, in fact, the right-of-way is with the crossing traffic. Because of these and other dangers of damaged traffic signs, maintenance crews make every effort to repair or replace them as soon as possible. To this end, in addition to the routine report of such sign damage by the police and concerned citizens, all important vehicular safety signs are routinely inspected on a day-to-day basis. In cities of substantial population, it will readily be understood that the expense involved in the policing, repair and replacement of damaged traffic warning signs will be very great.

In attempts to overcome the hazards of accidentally damaged traffic signs as described above, various kinds of self-erecting sign posts have heretofore been devised, principal among which are posts fabricated of a resilient material such as rubber, or metal posts supported upon helical springs or the like. Such sign posts, however, because of their yielding nature are subject to misuse, particularly by teenagers who purposely bent and release them in mischievous play. Because of the weight of the signs carried by such posts, such misuse in itself is extremely hazardous.

It is, accordingly, the principal object of this invention to provide a novel and improved self-erecting sign post that obviates the deficiencies of self-erecting sign posts heretofore devised.

A more particular object of the invention is to provide a self-erecting sign post of the character described, comprising, in combination, a rigid but frangible section and a co-extensive spring section so arranged that the spring section will be inoperative until the frangible section is first broken, and wherein the frangible section constitutes a zone of weakness which will break before the remainder of the sign post bends upon impact.

It is another object of the invention to provide a self-erecting sign post of the above nature wherein the frangible section can readily be replaced after accidental breakage to restore the sign post to its normal, rigid condition.

Another object of the invention is to provide a self-erecting sign post of the above nature which will be simple in construction, inexpensive to manufacture, effective in operation and durable in use.

Other objects, features and advantages of the invention will be apparent from the following description when read with reference to the accompanying drawings. In the drawings, wherein like reference numerals denote corresponding parts throughout the several views.

Figure 1:
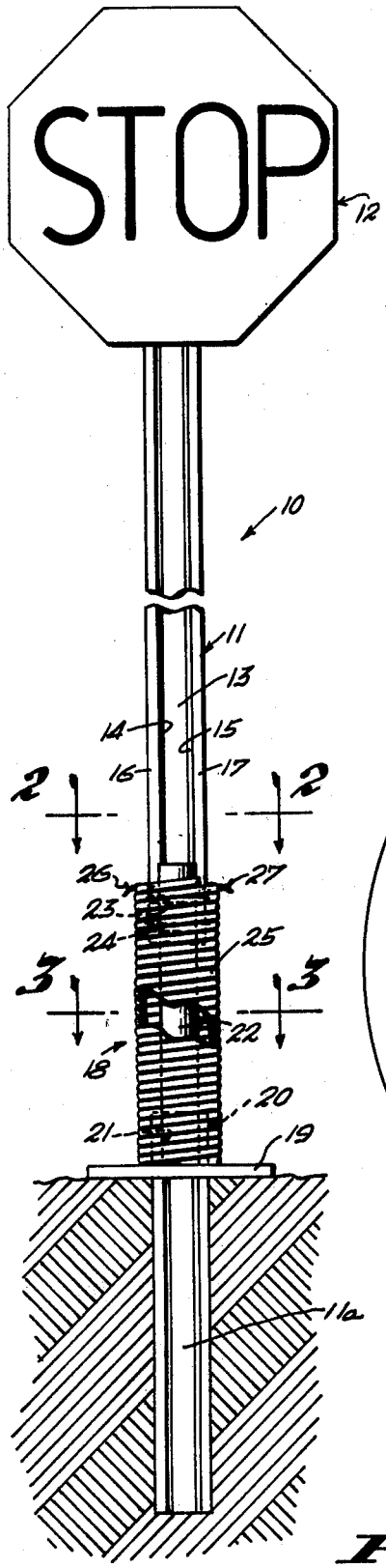
FIG. 1 is a front elevational view of a self-erecting sign post embodying the invention.
Figure 2:
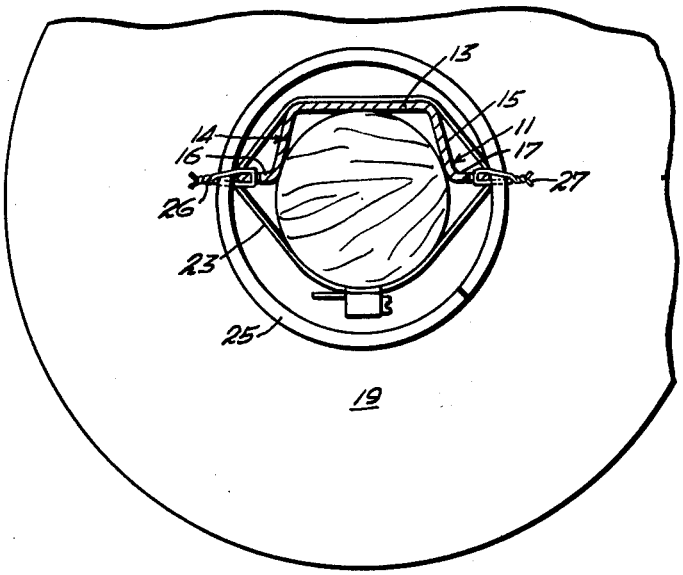
FIG. 2 is a transverse cross-sectional view taken along the line 2—2 of FIG. 1 in the direction of the arrows.
Figure 3:
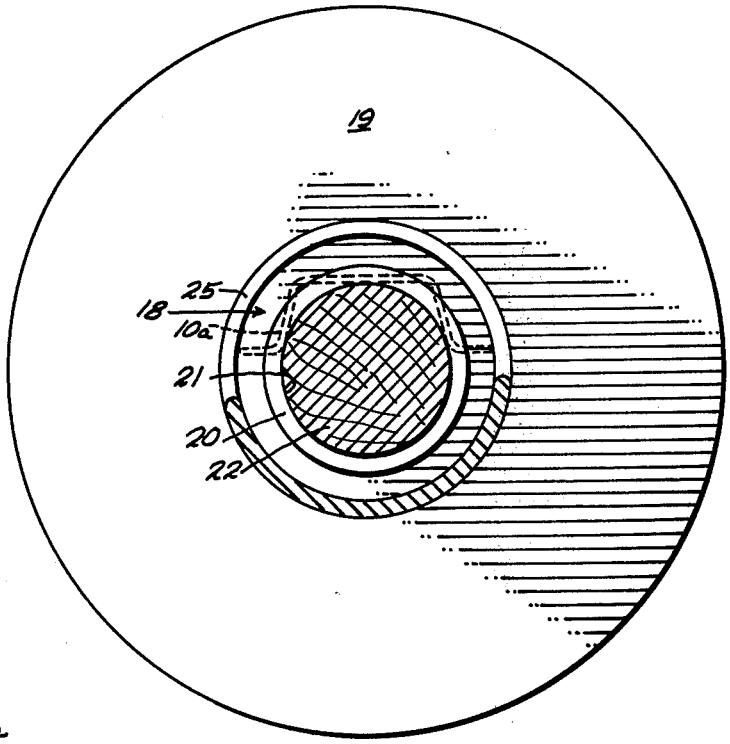
FIG. 3 is a transverse cross-sectional view taken along the line 3—3 of FIG. 1 in the direction of the arrows.

Referring now in detail to the drawings, reference numeral 10 designates, generally, a sign embodying the invention, the same comprising a self-erecting sign post 11 carrying, by way of example, a traffic sign 12 at its upper end. As best illustrated in FIG. 2, the sign post 11 may be fabricated of heavy sheet metal, stamped or otherwise formed so as to be of generally U-shaped cross-sectional configuration to provide, along its length, a flat bottom wall portion 13, and opposed, slightly divergent sidewall portions 14, 15 which terminate in comparatively short, opposed, outwardly-extending portions 16 and 17, respectively. As illustrated at 18 in FIG. 1, a gap is provided along the length of the sign post 11 at ground level, wherein there is substituted a frangible and resilient section as is hereinafter described.

The lower section **11*a* of the post 11 is adapted to be buried in the ground for support of the sign, and for this purpose it is approximately 18 inches long. The upper end of the lower section 11*a* has welded or otherwise secured thereagainst a circular metal plate 19, the underside of which is adapted to seat at ground level upon installation of the sign post. Secured centrally upon the upper surface of the metal plate 19, such as by welding, in a short, cylindrical length of pipe 20 providing a cylindrical recess or socket 21 adapted to snugly receive the lower end portion of a frangible dowel 22. The dowel 22, which will be approximately 18 inches in length, will preferably be fabricated of a hard wood of such strength as will hold the remainder of the sign rigid and erect under normal use, while at the same time being subject to breakage upon a substantial bending force being applied to the sign post 11**, such as might occur upon impact with the bumper of an improperly driven or out-of-control automotive vehicle.

The upper end of the frangible dowel 22 is removably secured to the upwardly-extending portion of the self-erecting sign post 11 as by a pair of longitudinally-spaced post clamps or the like 23, 24. A heavy, tightly-wound helical spring 25 has one end welded or otherwise secured to the circular metal plate 19 circumjacent the cylindtical length of pipe 20. The other end of the helical spring 25 closely surrounds a lower end portion of the sign post portion 11 and is removably attached thereto as by wire ties 26, 27, extending through openings drilled in the outwardly-extending portions 16, 17 of said sign post. In operation, it will be understood that the frangible dowel traversing the gap 18 in the sign post 11, being snuggly received in the socket provided by the cylindrical length of pipe 20 at one end, and being secured at its other end to the lower end of the upper post portion 11 by clamps 23, 24 normally maintains the sign in erect position with the required rigidity. Upon impact of the sign post above the spring 25 the frangible dowel 22 will break before bending of the sign post 11 can occur. Once this break has occurred, continued force of impact will result in bending of the helical spring 25. Upon removal or withdrawal of the vehicle or other striking object, the helical spring 25, in assuming its normal shape again, will return the sign post, together with its sign, to normal erect position, for its continued use in vehicle traffic control.

Removal and replacement of the dowel 22 is accomplished simply by loosening the hose clamps 23, 24 for removal of the upper broken portion of said dowel whereafter access from above permits easy removal of the lower section from its socket 22 for substitution by a new dowel. Separation of the upper portion of the self-erecting sign post 11 can be readily accomplished by untying the tie wires 26, 27.

While I have illustrated and described herein only one form in which my invention can conveniently be embodied in practice, it is to be understood that this embodiment is given by way of example only and not in a limiting sense.

What I claim as new and desire to secure by Letters Patent is:

1. A self-erecting sign post comprising in combination, a fist elongated metal post section, a second, comparatively-short, elongated metal post section, said first and second post sections normally being disposed is axially spaced, coaxial disposition, an elongated rigid but frangible section, means connecting opposite end portions of said frangible section to opposing end portions of said first and second post sections for normally retaining said post sections in rigidly interconnected relative disposition, and spring means interconnecting said opposing end portions of said first and second post sections, said frangible section constituting a zone of weakness operative to break before said first post section bends upon impact, said spring means comprising a helical spring circumjacent said frangible section and being operative to restore said first post section to its relatively aligned position, said second post section being adapted to be buried in the ground for supporting the sign post in erect position, the upper end of said second post section having affixed thereto in transverse relation a plate member adapted to abut at its underside the ground surface at which the sign post is installed, one end of said helical spring being secured to said plate member.

2. A self-erecting sign post as defined in claim 1 including a tubular member secured upon said plate member and providing a socket for the reception of the lower end of said frangible section.

3. A self-erecting sign post as defined in claim 2 wherein said means for connecting said frangible section to said first post section comprises a peripheral clamp.

4. A self-erecting sign post as defined in claim 3 wherein said frangible section is fabricated of a hard wood.

* * * * *